United States Patent [19]

Bewerse et al.

[11] 4,068,451

[45] Jan. 17, 1978

[54] PAPER BAG OPENING DEVICE

[76] Inventors: Richard A. Bewerse, Rte. 3, Box 601, Meritt Island, Fla. 32952; Stanley Joseloff, 185 S. Atlantic Ave., Cocoa Beach, Fla. 32931

[21] Appl. No.: 783,275

[22] Filed: Mar. 31, 1977

[51] Int. Cl.[2] ..... B31B 1/76

[52] U.S. Cl. ..... 53/385; 53/390; 93/28

[58] Field of Search ..... 53/385, 390, 384, 386; 93/28

[56] References Cited

U.S. PATENT DOCUMENTS

| | | | |
|---|---|---|---|
| 2,045,678 | 6/1936 | Shafer | 53/385 |
| 2,973,612 | 3/1961 | McGowan | 53/384 |
| 3,564,814 | 2/1971 | Graveley | 53/384 X |
| 3,605,383 | 9/1971 | Piazze | 53/385 |
| 3,699,741 | 10/1972 | Norman | 53/385 X |
| 3,740,922 | 6/1973 | Liou | 53/384 X |
| 3,822,527 | 7/1974 | Germunson et al. | 53/385 X |

*Primary Examiner*—James F. Coan
*Attorney, Agent, or Firm*—Charles E. Temko

[57] ABSTRACT

A device for serially opening a plurality of paper bags in rapid succession and placing them in a predetermined location for manual loading. The device is particularly useful at checkout counters at supermarkets and similar locations, and includes means for moving successive bags from a horizontal orientation in a stack to a vertical position, opening the bag whereby it may stand upon its bottom wall, and moving the bag upon demand to a loading position.

4 Claims, 14 Drawing Figures

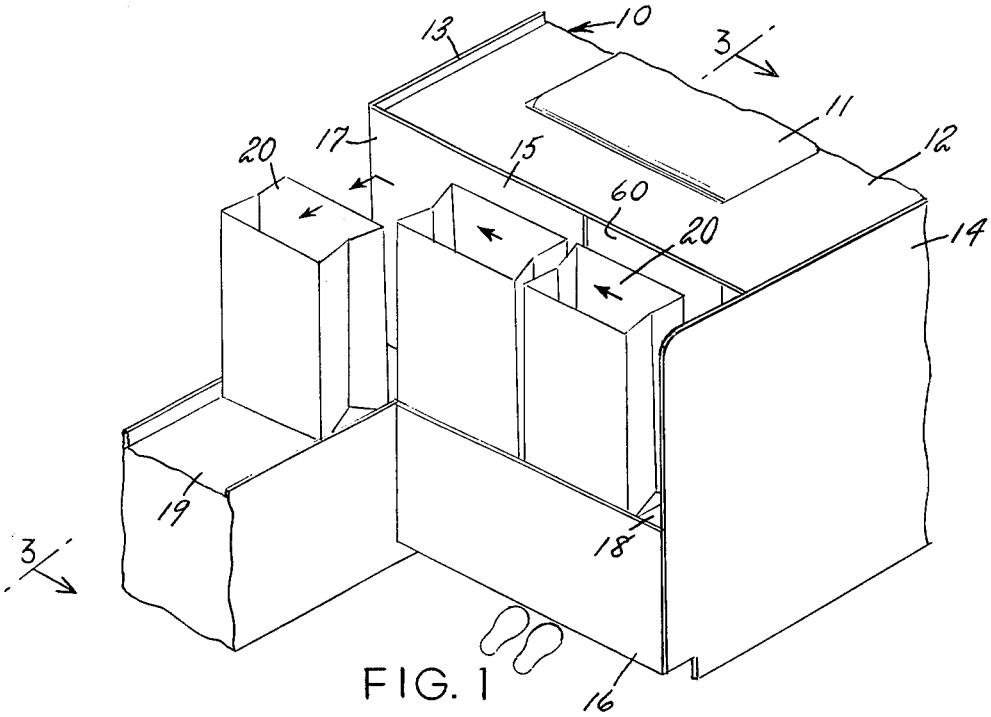
FIG. 1
FIG. 4
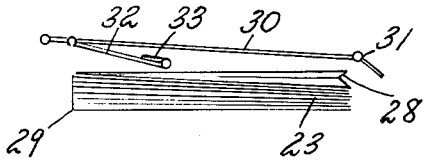
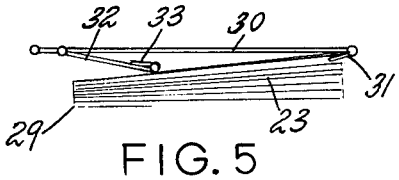
FIG. 5
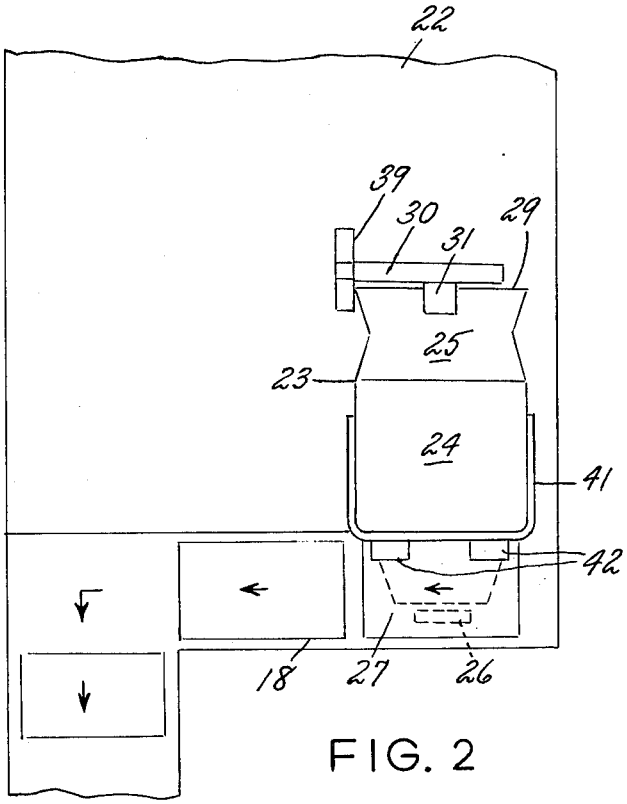
FIG. 2
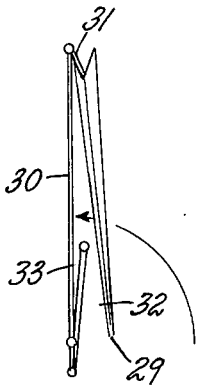
FIG. 6
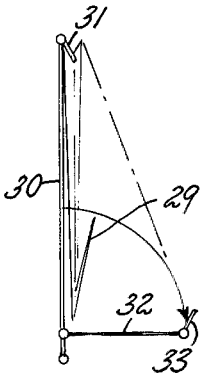
FIG. 7

FIG. 3
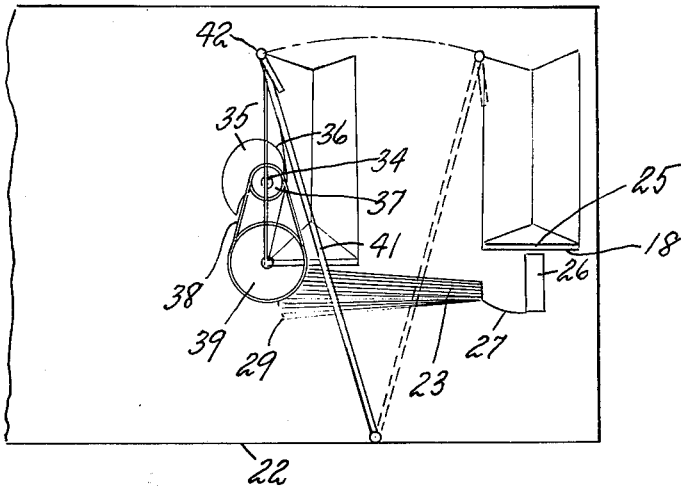
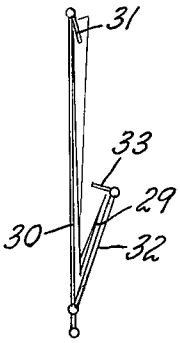
FIG. 8
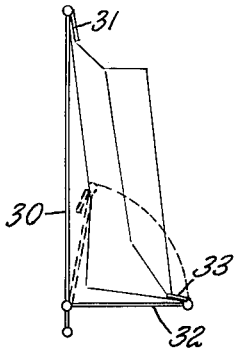
FIG. 10
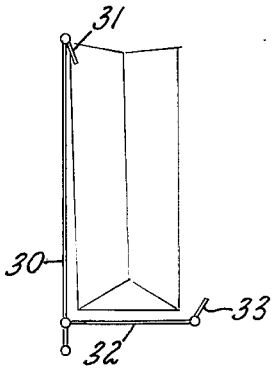
FIG. 11
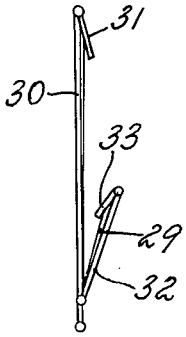
FIG. 9
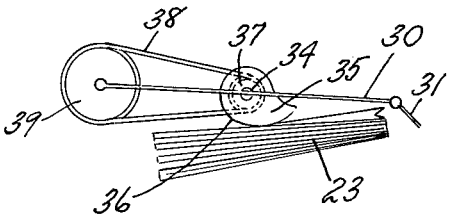
FIG. 12

PAPER BAG OPENING DEVICE

BACKGROUND OF THE INVENTION

This invention relates generally to the field of bag opening devices, and more particularly to an improved device for serially opening a stack of conventional paper bags having a bottom wall upon which the bag may be stood, and subsequently transferring the bag to a loading point.

Various types of bag opening and loading devices are known in the prior art. Some devices employ vacuum means to open the bag, an expedient which is not suitable where the wall of the bag is porous such as kraft paper bags, etc. Others require a degree of hand manipulation which slows the worker who would otherwise be occupied in manually filling the bags. Still others require elaborate installation, and are expensive to manufacture.

SUMMARY OF THE INVENTION

Briefly stated, the invention contemplates the provision of an improved bag opening device adapted to be conveniently installed within a loading counter, which provides the serial function of partly opening the mouth of the uppermost of a stack of horizontally oriented conventional paper bags, raising the same to a vertical position, opening the lower flap which forms the flat bottom wall of the bag, and swinging of the now-opened bag, upon demand, to a loading position. The device includes a plurality of pivotally mounted arms, each having clamping means on the free ends thereof, and means for controlling the cyclic operation thereof. The device employes a low velocity air current provided by a small fan or blower, rather than vacuum to cause the opening of the mouth of the bag. The sequence and timing of each operation is controlled by a set of pneumatic valves operated by cams driven by an electric motor of known type. These valves operate pneumatic cylinders which are powered by compressed air supplied adjacent or remote from the device. The cylinders perform the various functions described hereinbelow. The motor is at rest at the completion of a cycle and is actuated by the closing of a manually operated demand switch to start a new cycle. A switch marked "load" most advantageously positions the various arms to facilitate expeditious loading.

BRIEF DESCRIPTION OF THE DRAWINGS

In the drawings, to which reference will be made in the specification, similar reference characters have been employed to designate corresponding parts throughout the several views.

FIG. 1 is a fragmentary view in perspective of an embodiment of the invention.

FIG. 2 is a fragmentary top plan view thereof.

FIG. 3 is a fragmentary sectional view as seen from the plane 3—3 in FIG. 1.

FIG. 4 is a schematic view showing a first step in the opening of an uppermost bag in a stack of bags.

FIG. 5 is a schematic view showing a second step.

FIG. 6 is a schematic view showing a third step.

FIG. 7 is a schematic view showing a fourth step.

FIG. 8 is a schematic view showing a fifth step.

FIG. 9 is a schematic view showing a sixth step.

FIG. 10 is a schematic view showing a seventh step.

FIG. 11 is a schematic view showing the completion of a bag opening cycle, with an opened bag awaiting transfer to a loading station.

FIG. 12 is a schematic side elevational view of a part of a bag opening means.

DETAILED DESCRIPTION OF THE DISCLOSED EMBODIMENT

Figure 13:
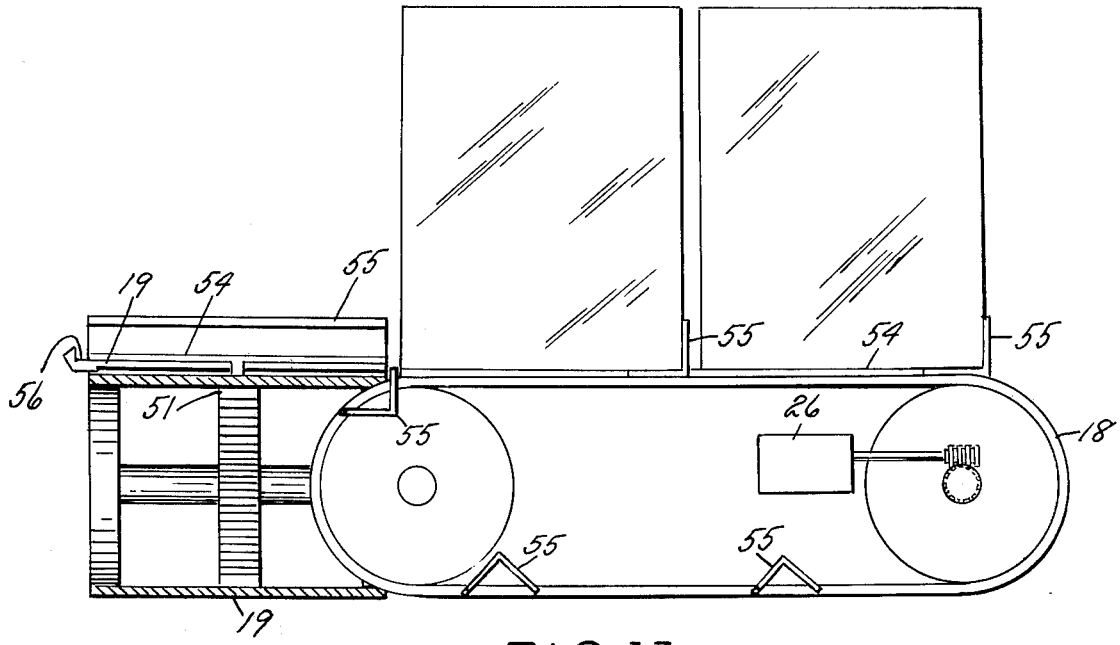
FIG. 13 is a fragmentary schematic vertical sectional view of open bag transport means.

In accordance with the invention, there is illustrated in FIG. 1 of the drawing a typical checkout counter, generally indicated by reference character 10, including a feeding belt 11 positioned in an upper horizontal wall 12. The counter also includes side walls 13 and 14, an upper end wall 15, and a lower end wall 16, which form a recess 17 having a transverse belt 18 and longitudinal belt 19 for transporting opened bags 20, on demand.

Referring to FIGS. 2 and 3, a support means in the form of a subfloor 22 supports a stack of conventional folded bags 23, each bag including an upper and lower side wall, the upper one of which is indicated by reference character 24. A bottom wall 25 illustrated in open condition is above the upper wall surface and is shown as the inside surface of the bottom of the bag. Adjacent the stack 23 is a fan or blower 26, the output of which impinges upon a curved air chute 27 which creates sufficient air flow to open the uppermost bag in the stack at the opened end 28 thereof. The closed end 29 remains folded during the initial opening step.

Referring to FIGS. 4 to 10, inclusive, a bag-handling arm 30 has an associated bag mouth clamp 31 on a free end thereof, and is arranged for pivotal movement about a horizontal axis. A bag-opening arm 32 has an associated clamp 33, and is arranged for pivotal horizontal movement about a parallel horizontal axis. This movement is accomplished by means of individual compressed air cylinders (not shown), the pistons of which act radially extending cranks (also not shown) carried by shafts forming the axes of pivotal movement, in well known manner. Timing sequences may be accomplished by a single timing motor which operates the air valves in turn actuating the air cylinders, or, if desired, a series of microswitches may be employed whereby the completion of movement of an arm initiates the commencement of moving of another.

FIGS. 4 through 10, inclusive, show the individual steps of progressively separating the uppermost bag from the stack 23, moving it to a vertical position, and subsequently unfolding the bottom wall so that it will stand in open erected condition on its bottom wall. In FIG. 4, the bag-handling arm 30 is in horizontal position, with the bag mouth clamp 31 opened. With the commencement of a cycle of operation, air from the fan 26 strikes the chute 27, and impinges upon the abutted free edges of the mouth of the bag to separate the upper edge thereof from the lower edge thereof. With this separation achieved, as shown in FIG. 4 at 28, the bag mouth clamp 31 is now closed to engage the upper edge (FIG. 5). The bag is then raised to vertical position as shown in FIG. 6. During this movement, the bag-opening arm 32 is carried to vertical position and remains folded, clear of the lower portion of the bag, so as not to disturb the engagement of the mouth of the bag with the bag-handling arm.

The next step is to unfold the lower closed end 29 of the bag, and this is accomplished as seen in FIG. 7 by returning the bag-opening arm 32 to horizontal position, during which movement it pushes itself beneath the lower closed edge of the bag, as indicated in dashed lines. The clamp 33 is then opened. In the next step, as seen in FIG. 9, the bag-opening arm, having passed the lower edge of the bag returns to quasi-vertical position whereby the clamp 33 is positioned adjacent the folded edge bounding the bottom wall flap, following which the clamp 33 closes, a seen in FIG. 9, upon the edge of the bottom wall, and swings downwardly again, as shown in FIG. 9, to a horizontal position, this movement substantially opening the bag, and completing the bag opening cycle shown in FIG. 11.

Referring to FIG. 12, to assure that the bag-handling arm 30 moves downwardly a proper distance to engage the clamp 31, the midpoint 34 of the arm 30 mounts a positioning cam 35, the lower face 36 of which contacts the stack 23. A small sprocket 37 fixed with respect to the cam 35 entrains a sprocket chain 38 also entrained on a stationary sprocket 39. Thus, the downward movement of the handling arm, the lower face 36, upon contacting the stack 23 prevents further downward movement, and simultaneously positions the clamp 31 in proper relation to the upper open edge of the mouth of the bag.

Referring to FIG. 3, upon the completion of the bag-opening cycle, means is provided for transferring an opened bag to a delivery arm 41. The arm 41 and associated clamps 42 engage the side portion 24 prior to movement best seen in FIG. 2. The closing of the clamp 42 is used as a signal for release of the bag mouth clamp 31.

With successive bags in loading position (see FIG. 1), loading of the bags is accomplished manually, with serial transport to a position where they may be transferred to a shopping cart or other vehicle.

It will be observed that the present construction permits careful manual loading of each bag, which maximum space utilization, rather than relying upon random positioning of the articles to be packed on a loading tray, and subsequent sliding into a bag, which wastes considerable space within the bag, and often disposes the contents such that relatively sharp edges can cut the bag when the bag is lifted. Because of the relative simplicity of construction of the present device, the cost of manufacture and installation is correspondingly low.

Figure 14:
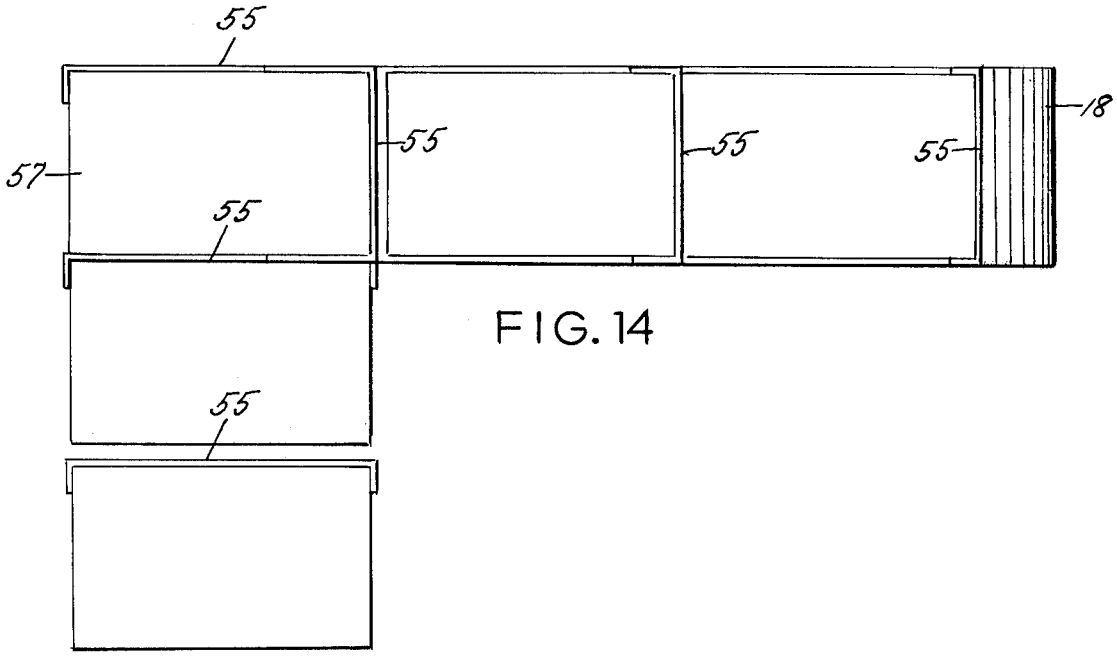
FIG. 14 is a fragmentary schematic plan view showing the incremental advancement of opened bags from a loading station.

Referring to FIGS. 13 and 14, the belts 18 and 19 are each of molded type. A propelling device 53 incrementally advances the bags disposed on the upper surfaces 54. To prevent slippage, pivotally mounted bag-engaging members 55 are provided which are raised to projected position by contact with deployment surfaces 56 during travel through a bag-pushing segment of the path of movement of the individual belt. The members 55 retract under the influence of resilient means (not shown) during the return segment of movement. Advancement of the belt 18 is coordinated with advancement of the belt 19, so that transverse advancement of a bag on the belt 18 occurs when a corner 57 has been vacated by the belt 19.

Expeditious restocking of a depleted bag supply 23 is accomplished by pushing a button marked (not shown) "reload". This interrupts an otherwise normal cycle at a point where the various arms are best positioned for convenience in inserting a new supply of bags. Bag-handling arm 41 is depicted in this position in FIG. 3. Loading is accomplished through the front opening 60 shown in FIG. 1, or by way of a door (not shown) on the right hand side of the enclosure in the counter.

We wish it to be understood that we do not consider the invention limited to the specific details of structure shown and described in the preceeding specification, for obvious modifications will occur to those skilled in the art to which the invention pertains.

We claim:

1. An improved folded paper bag opening device comprising: support means supporting a stack of folded bags in substantially horizontal orientation; an elongated bag-handling arm having a first end pivoted for rotation about a horizontal axis above said support means, said bag-handling arm having associated bag clamping means on a second end thereof; a bag-opening arm having a first end pivotally mounted for rotation about an axis parallel to that of said bag-handling arm, and having clamping means on a free opposite end thereof, said bag-opening arm being shorter in length than said bag-handling arm; means for cyclically moving said bag-handling arm between horizontal and vertical positions, and for opening and closing said associated clamping means when said bag-handling arm is at said horizontal and vertical positions; low velocity air current supply means positioned adjacent said stack supporting means to apply a current of air serially to the opened ends of said folded bags in said stack; said bag-handling arm progressively lowering to position its associated clamping means adjacent an open end of an uppermost bag in said stack to contact said bag under the influence of said air current supply means, and close said clamp means thereon; said bag-handling arm thereafter elevating to vertical position; said bag-opening arm subsequently pivoting downwardly beneath a lower closed edge of said engaged bag, and subsequently upwardly to engage a free edge of a bottom wall of said bag with its associated clamping means, and thereafter downwardly, to move said bottom wall to a horizontal plane and fully open said bag.

2. A device in accordance with claim 1, further characterized in means for determining the horizontal end of the path of travel of said bag-handling arm with variations in the height of said stack of folded bags.

3. A device in accordance with claim 1, further characterized in the provision of bag-delivery means pivotally supported on said horizontal support means, said bag-delivery means including a bag-delivering arm having associated clamping means carried on a free end thereof, said bag-delivering arm being selectively positionable in the area of an opened bag supported by said bag-handling arm, with said associated clamping means engaging a free edge of said bag to transfer the same from said bag-handling arm and move said bag to a loading location.

4. A device as claimed in claim 3, further characterized in the provision of a moving belt passing through said loading location.

* * * * *